United States Patent [19]

Lee

[11] Patent Number: 5,007,311

[45] Date of Patent: Apr. 16, 1991

[54] SLIDABLE DRIVING STUD FOR USING IN SOCKET WRENCH AND ITS MANUFACTURING PROCESS

[76] Inventor: Clark J. Lee, 429-6 Chung Cheng Rd, Fu Liao Li, Tsao Tun Town, Nantou Hsien, Taiwan

[21] Appl. No.: 565,429

[22] Filed: Aug. 10, 1990

[51] Int. Cl.[5] ..... B25B 13/46

[52] U.S. Cl. ..... 81/61; 81/177.85

[58] Field of Search ..... 81/177.85, 60, 61

[56] References Cited

U.S. PATENT DOCUMENTS 1,807,134 5/1931 Pfauser ..... 81/61

1,873,472 8/1932 Pfauser ..... 81/61

3,638,519 2/1972 Rebold ..... 81/60 X

*Primary Examiner*—D. S. Meislin

*Attorney, Agent, or Firm*—Bacon & Thomas

[57] ABSTRACT

The slidable driving stud of present invention is usually maintained in position by means of a pin carried by the ratchet wheel and engaging within a longitudinal groove on the slidable driving stud for limiting the movement of the slidable driving stud with respect to the ratchet wheel, the improvement which comprises the longitudinal groove extending from one end to another end of the driving stud; and a pair of spring biased ball detents being mounted on the vertical groove and near each end of the driving stud respectively to block the vertical groove.

1 Claim, 3 Drawing Sheets

SLIDABLE DRIVING STUD FOR USING IN SOCKET WRENCH AND ITS MANUFACTURING PROCESS

BACKGROUND OF THE INVENTION

This invention relates to new and useful improvements in reversible socket wrenches, and more particularly to a reversible socket wrench having a slidable driving stud which can be pushed to project from either side of the wrench head.

Edward M. Pfauser in U.S. Pat. No. 1,873,472 discloses a reversible socket wrench including a push plug structure, wherein the push plug is maintained in position by means of a pin carried by the ratchet head and operating in a longitudinal groove having a vertical wall at each end thereof on the push plug for limiting the movement of the push plug with respect to the head. In the manufacture of push plugs of this type, it has been found that an additional manufacturing process is required for forming the vertical groove, and thus adds to the cost of manufacturing.

SUMMARY OF THE INVENTION

An object of the present invention is to provide a reversible socket wrench having a slidable driving stud which is easy to be manufactured.

The slidable driving stud of the present invention is usually maintained in position be means of a pin carried by the ratchet wheel and engaging within a longitudinal groove on the slidable driving stud for limiting the movement of the slidable driving stud with respect to the ratchet wheel, the improvement which comprises the longitudinal groove extending from one end to another end of the driving stud; and a pair of spring biased ball detents being mounted on the vertical groove and near each end of the driving stud respectively to block the vertical groove.

The slidable driving stud can be pushed to move laterally of the ratchet wheel such that one-half of the driving stud is retained within the ratchet wheel as one of the spring biased ball detents engages with the pin and the other half projects to one side of the ratchet wheel with another spring biased ball detent thereon to retain a socket.

Because the verticle groove extends from one end to the another end of the driving stud, it can be formed simultaneously in a manufacturing process of polygonal cross section metal stud comprising drawing or pressing a metal rod through a die which defines the desired cross section.

BRIEF DESCRIPTION OF THE DRAWINGS

In the various views, like the reference numbers refer to like elements.

DETAILED DESCRIPTION OF THE PREFERRED EMBODIMENT

Figure 1:
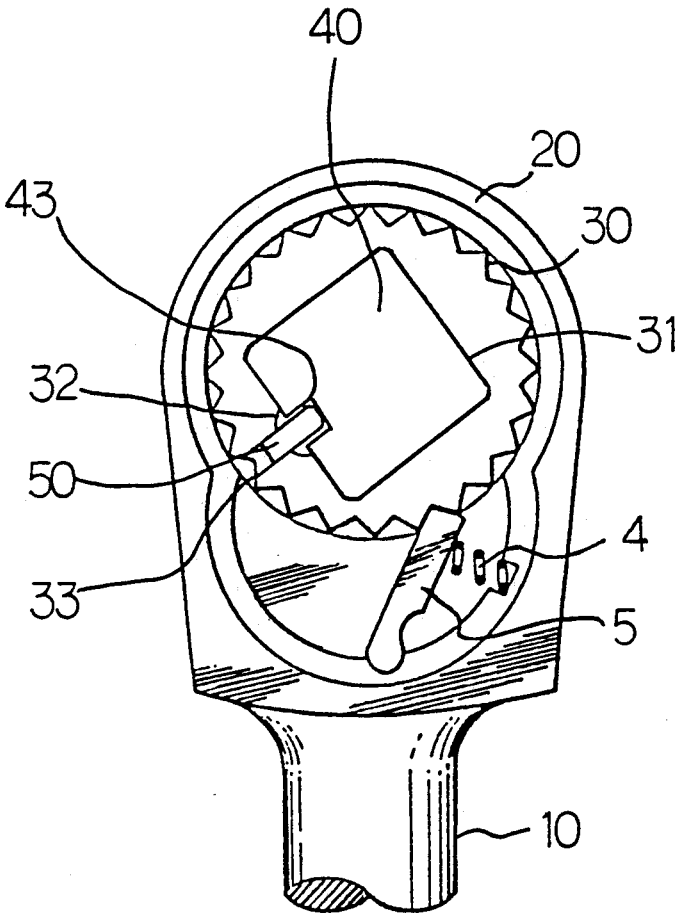
FIG. 1 is a partial sectional view of the reversible socket wrench which illustrates the construction of a slidable driving stud of the present invention.

The present invention will be described in greater detailed with reference to the accompanying drawings wherein a preferred embodiments of the present invention is set forth. As shown in FIG. 1, a reversible socket wrench containing a slidable driving stud construced in accordance with the present invention generally comprises a wrench body including a head 20 and a handle 10 extending therefrom; a ratchet wheel 30 having a square hole 31 through its middle which is rotatably mounted in the head 20; a pawl 5 which is pivotally connected to the head 20 at one end engaged with the ratchet teeth of the ratchet wheel 30 at another end; and a compression spring 4 which is bounded between the pawl 5 and the head 20 to biase the pawl 5 toward the ratchet wheel 30 for maintaining the engagement therebetween. The ratchet wheel 30 can only be rotated in one direction with respect to the handle 10.

Figure 2:
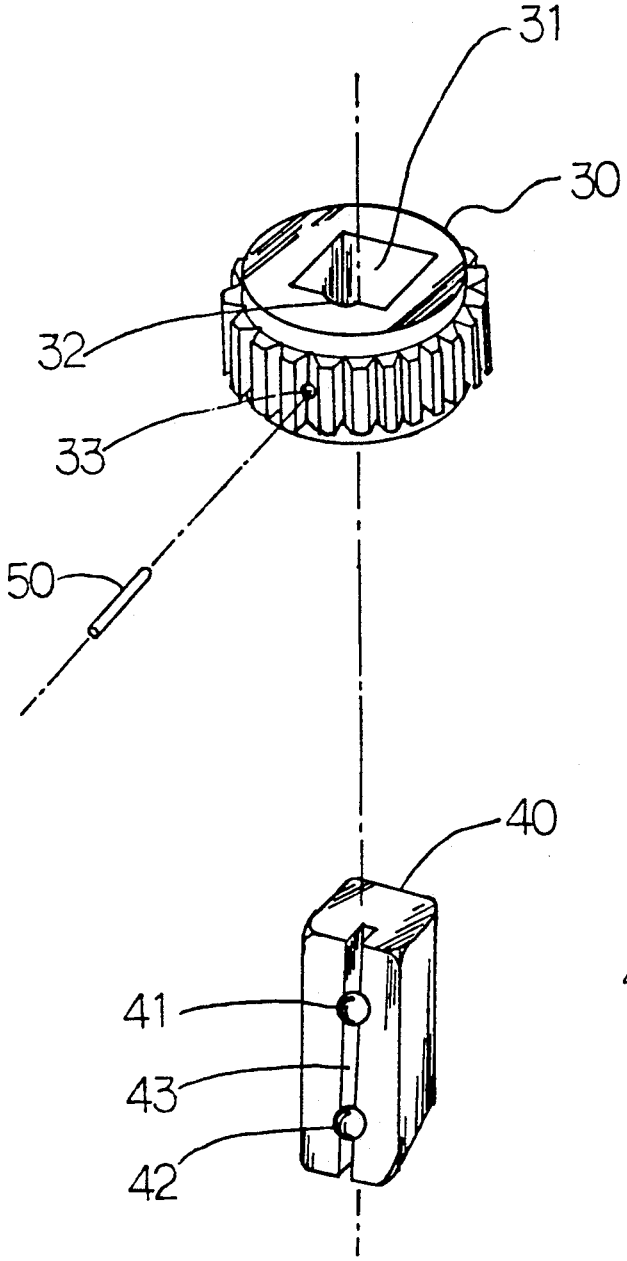
FIG. 2 is an exploded perspective view that illustrates the ratchet wheel 30 and the slidable driving stud 40 in FIG. 1.
Figure 3:
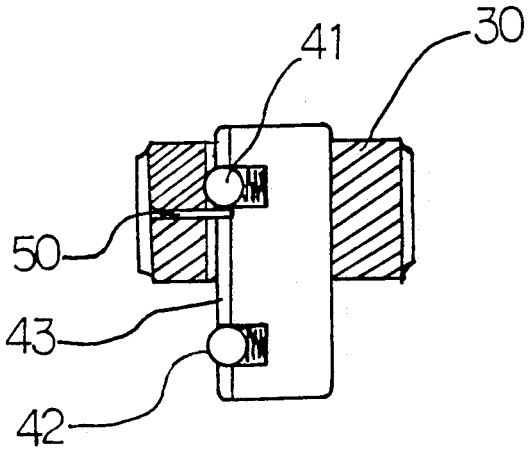
FIG. 3 is a vertical, sectional view of the ratchet wheel 30 and the slidable driving stud 40 in FIG. 2.

As shown in FIGS. 1, 2 and 3, the ratchet wheel 30 has a lateral round groove 32 on one of side walls of the square hole 31, and between the round groove 32 and the teeth a bore 33 drilled transversely at the middle portion of the ratchet wheel 30. A driving stud 40 has a square cross section corresponding to the square hole 31, and a longitudinal verticle groove 43 formed on one of its sides and extending from one end to another end thereof. A pair of spring biased ball detents 41, 42 are mounted near each end of the driving stud 40 and on the groove 43 respectively. The driving stud 40 is received in the square hole 31 with its verticle groove 43 facing the round groove 32 on the square hole 31, and consequently with the ball detent 41 or 42 frictionally engaging with the round groove 32.

A pin 50 having a diameter slightly larger the diameter of the bore 33 and a chamfered end is press-fitted into the bore 33 to engage within the verticle groove 43 between the ball detents 41 and 42 for limiting the movement of the driving stud 40 through the ratchet wheel 30.

As shown in FIG. 3, when the driving stud 40 is pushed to protrude from one side of the ratchet wheel 30, the ball detent 41 will engage with the pin 50 such that about one-half of the driving stud 40 is retained within the square hole 31, in the meantime a socket can be retained by the ball detent 42 for reversibly tightening (or loosening) a threaded screw. Consequently, when the driving stud 40 is pushed to protrude from another side of the ratchet wheel 30, the ball detent 42 will engage with the pin 50 and a socket can be retained by the ball detent 41 for reversibly loosening (or tightening) a threaded screw.

It has been found that in order to curtain expense in the manufacture of the slidable driving stud which is maintained in position by means of a pin carried by the ratchet wheel and engaging within a longitudinal groove on the slidable driving stud, the structure described above and illustrated in the accompanying drawing is far superior to any known art at the present time, and the effectiveness of the slidable driving stud is not interfered with in any manner whatever.

Figure 4:
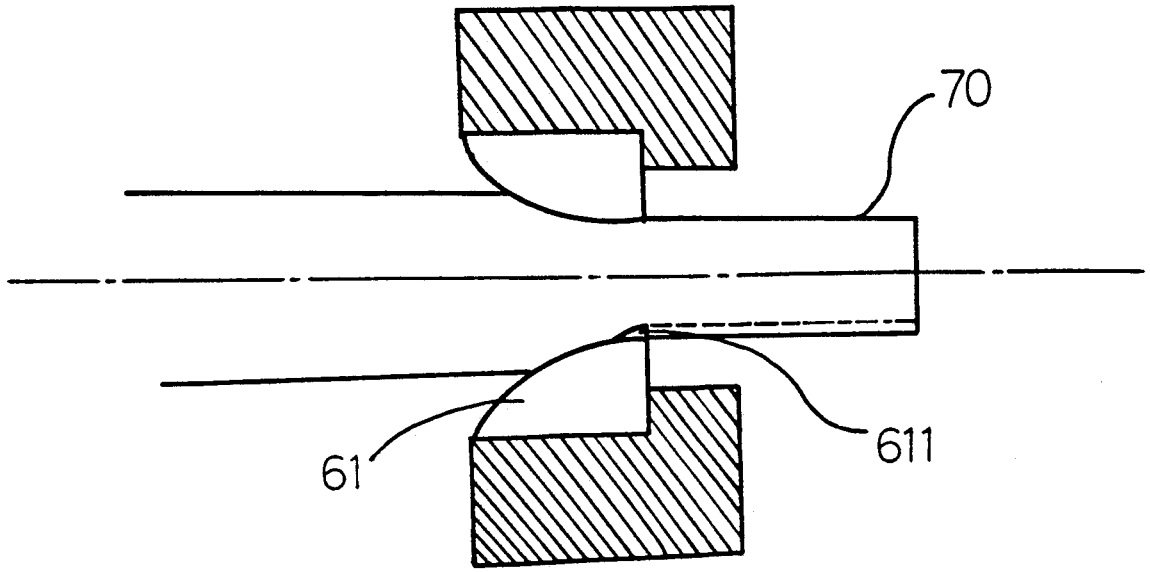
FIG. 4 is a vertical, sectional view which shows that a metal rod is drawed through a die to form a stud having a cross section defined by the die.
Figure 5:
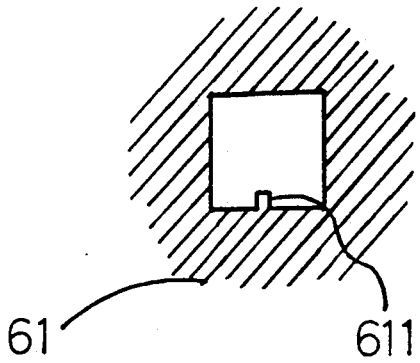
FIG. 5 is a plan view that shows the cross section defined by the die in FIG. 4.

The idea of extending the longitudinal groove 43 from one end to another end of the driving stud 40 will be readily appreciated when it is understood that a driving stud having an uniform cross section is easier and far less expensive to be manufactured than a driving stud an non-uniform cross section. A process for manufacturing the driving stud of present invention comprises drawing a continuous metal rod through a restriction die defining a desired cross section, cutting and mounting the ball detents on the drawn metal rod. As shown in FIGS. 4 and 5, a continuous metal rod is drawn through a restriction die 61 to produce a drawn metal rod 70 having a substantially square cross section, in which an obstacle 611 located on the die 61 is used to form the longitudinal groove 43.

What is claimed is:

1. An improved ratchet wrench comprising a head, a handle extending therefrom, a ratchet wheel rotatably mounted in the head having a polygonal receiving hole along an axis perpendicular to the handle, ratchet means for connecting the ratchet wheel to rotate with the handle around said axis in only one direction, and a driving stud having a length greater than the length of the receiving hole and having a longitudinally extending guide groove in one side thereof, said driving stud being slidably mounted in the receiving hole and maintained in position by a pin mounted in the ratchet wheel and engaging within the guide groove on the driving stud, wherein the improvement comprises the longitudinal guide groove extending from one end to the opposite end of the driving stud, and a pair of socket detent members being mounted on the guide groove and adjacent to the opposite ends of the driving stud for limiting the relative movement of the pin within the guide groove, whereby one portion of the driving stud is retained within the ratchet wheel as one of the detent members engages with the pin and the other portion of the driving stud protrudes from one side of the ratchet wheel with another detent member thereon to retain a socket.

* * * * *